US011485556B1

(12) United States Patent
Brenner

(10) Patent No.: US 11,485,556 B1
(45) Date of Patent: Nov. 1, 2022

(54) VESSEL CONNECTOR

(71) Applicant: Vincent Charles Brenner, South Haven, MI (US)

(72) Inventor: Vincent Charles Brenner, South Haven, MI (US)

( * ) Notice: Subject to any disclaimer, the term of this patent is extended or adjusted under 35 U.S.C. 154(b) by 158 days.

(21) Appl. No.: 16/391,913

(22) Filed: Apr. 23, 2019

Related U.S. Application Data

(60) Provisional application No. 62/634,974, filed on Feb. 26, 2018.

(51) Int. Cl.
*B44D 3/00* (2006.01)
*B65D 71/50* (2006.01)

(52) U.S. Cl.
CPC ..... *B65D 71/502* (2013.01); *B44D 3/006* (2013.01)

(58) Field of Classification Search
CPC ..... B65D 71/502; B65D 71/00; A46B 17/06; A46B 17/02; A46B 17/00; B44D 3/00; B44D 3/006
See application file for complete search history.

(56) References Cited

U.S. PATENT DOCUMENTS 3,955,670 A * 5/1976 Buslik ..... A46B 17/06 206/15.3
4,625,780 A 12/1986 Burnham
4,865,188 A * 9/1989 Custeau ..... B44D 3/006 206/209
5,490,545 A * 2/1996 Sokoloff ..... A63F 7/045 138/40
5,540,363 A * 7/1996 Wilson ..... B44D 3/125 220/4.23
6,213,329 B1 * 4/2001 Dobson ..... B44D 3/127 220/736
6,457,899 B1 * 10/2002 Lin ..... G09B 23/12 141/319
7,383,948 B1 * 6/2008 Richardson ..... B44D 3/006 206/229
7,748,524 B2 * 7/2010 Ruzumna ..... B44D 3/125 206/209
9,145,245 B1 * 9/2015 Visser ..... B65D 71/00
10,552,552 B2 * 2/2020 Lawson ..... F16L 23/006

* cited by examiner

*Primary Examiner* — Javier A Pagan
(74) *Attorney, Agent, or Firm* — Hultman Law, PLC; Eric Andrew Hultman, Esq.

(57) ABSTRACT

The invention described herein provides a method and apparatus for supporting an object inside a vessel. The device comprises a vessel connector 20 having an annular ring 32, with an internal flange 38, and preferably a first 34 and second 36 set of threads. The vessel connector 20 supports and locates a support membrane 58 having a perforation 66 into which an object 28, such as a paintbrush 30 is inserted. The support membrane 58 locates a portion of the object internal to a connected vessel 22 which may be filled with solvent 54 thereby allowing the object 28 to be cleaned while limiting harmful chemicals from entering the environment through evaporation.

20 Claims, 7 Drawing Sheets

VESSEL CONNECTOR

CROSS REFERENCE TO RELATED APPLICATION

This application is a non-provisional application claiming priority to an earlier filed U.S. provisional patent application entitled, "Vessel Connector" filed Feb. 26, 2018, and assigned Ser. No. 62/634,974, the contents of which are incorporated herein by reference.

BACKGROUND OF THE INVENTION

Field of the Invention

The present invention generally relates to devices for cleaning, more specifically to devices for cleaning objects, and particularly to a vessel connector for supporting an object to be cleaned within a vessel.

Description of the Related Art

Prior art connectors for attaching vessels to one another include U.S. Pat. No. 4,625,780A, to Burnham (Shown in FIG. 1) which shows two threaded bottles attached via a central connector. Burnham discloses two narrowly tapered vessels feeding into a vortex generator, which comprises a venturi, or necked portion inside the generator. The narrow neck of the bottles when combined with necked passage in the connector (venturi) create a vortex within the upper vessel as fluid is passed between the upper and lower containers. However, the prior art does not disclose any means for cleaning, let alone for supporting a tool to be cleaned inside the vessels. Due to the narrowed design the prior art in fact teaches away from the instant invention disclosed herein.

Typical prior art methods of cleaning paint brushes involve using solvents and other harsh chemicals to separate paints and stains from a brush's bristles. This separation process oftentimes involves repeatedly wetting a brush with solvent and then removing the paint or stains from the brush using a comb. Alternately, a brush maybe left to sit in a solvent in order to loosen or dissolve the paint. In both of these methods, the harmful chemicals are allowed to evaporate into the air causing pollution. Additionally, if the brush is allowed to dry out, the brush may begin to harden which can impair its function.

The invention described herein solves these disadvantages by providing a method and apparatus for supporting a device inside a vessel containing a solvent that both supports the brush, allows it to remain wetted, and also limits evaporation. The inventive system provides for simplified cleanup, reduced VOC exposure, reduced solvent usage, provides for consistent brush cleaning results, as well as other advantages.

SUMMARY OF THE INVENTION

The vessel connector described herein is an apparatus capable of sealing a vessel. The connector is comprised of an annular ring having a flange located on its inside surface. This flange supports a support membrane having at least one perforation which is sized to support and locate an object passed through the perforation. It is suitable for mounting to a vessel, and is capable of locating and supporting an object located inside the vessel, the object passing through the perforation in the support membrane.

In another form of the invention the vessel connector is assembled to two separate vessels forming an enclosed environment and provides for the support of a tool, such as a paintbrush, inside this environment. This is accomplished by providing an annular ring having: a first thread sized to mate with a first threaded vessel; a second thread sized to mate with a second threaded vessel; a flange located on an inside surface of the annular ring and centered between the first thread and the second thread; and wherein the first thread and said second thread are co-axial with each other. Further, the first vessel has a threaded opening on a top portion which terminates in a lip, and the second vessel has a threaded opening on its bottom portion. A support membrane is provided and has at least one drain hole and at least one perforation which supports and locates a paintbrush which is passed through this perforation. The first vessel is then threaded onto the annular ring causing its flange to compress the support membrane against the first vessel's lip creating a seal between the annular ring's flange and the first vessel. The second vessel is then screwed onto the other side of the annular ring forming an enclosed environment.

In yet another form of the invention the vessel connector provides a method for supporting an object to be cleaned. In this method, a vessel connector is provided which has an annular ring shape and a flange on its inside surface. A support membrane having at least one perforation is also provided wherein an object to be cleaned is passed through its perforation and held in place by the support membrane. Next, a vessel such as a mason jar is provided having a lip on its topmost edge. The vessel connector is then attached onto the vessel in a manner that causes the annular ring's flange to compress the support membrane against the vessel's lip creating a seal between the vessel and the vessel connector's flange. This arrangement locates at least a portion of an object to be cleaned inside the first vessel wherein it may be exposed to a solvent located therein.

BRIEF DESCRIPTION OF THE DRAWING FIGURES

Other advantages of the present invention will be readily understood by reference to the following detailed description in connection with the accompanying drawings wherein.

DESCRIPTION OF THE VARIOUS EMBODIMENTS

Figure 1:
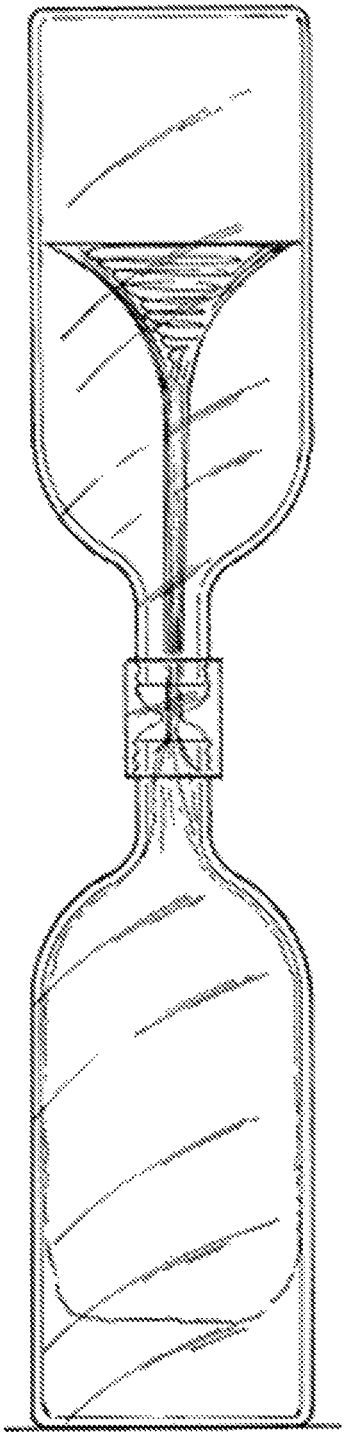
Prior Art FIG. 1
FIG. 1 is a side view of a prior art vortex generator used for attaching two vessels together and containing a central necked orifice shaped in a manner to create a vortex in an upper vessel when fluids are passed from the upper to the lower vessel.
Figure 2:
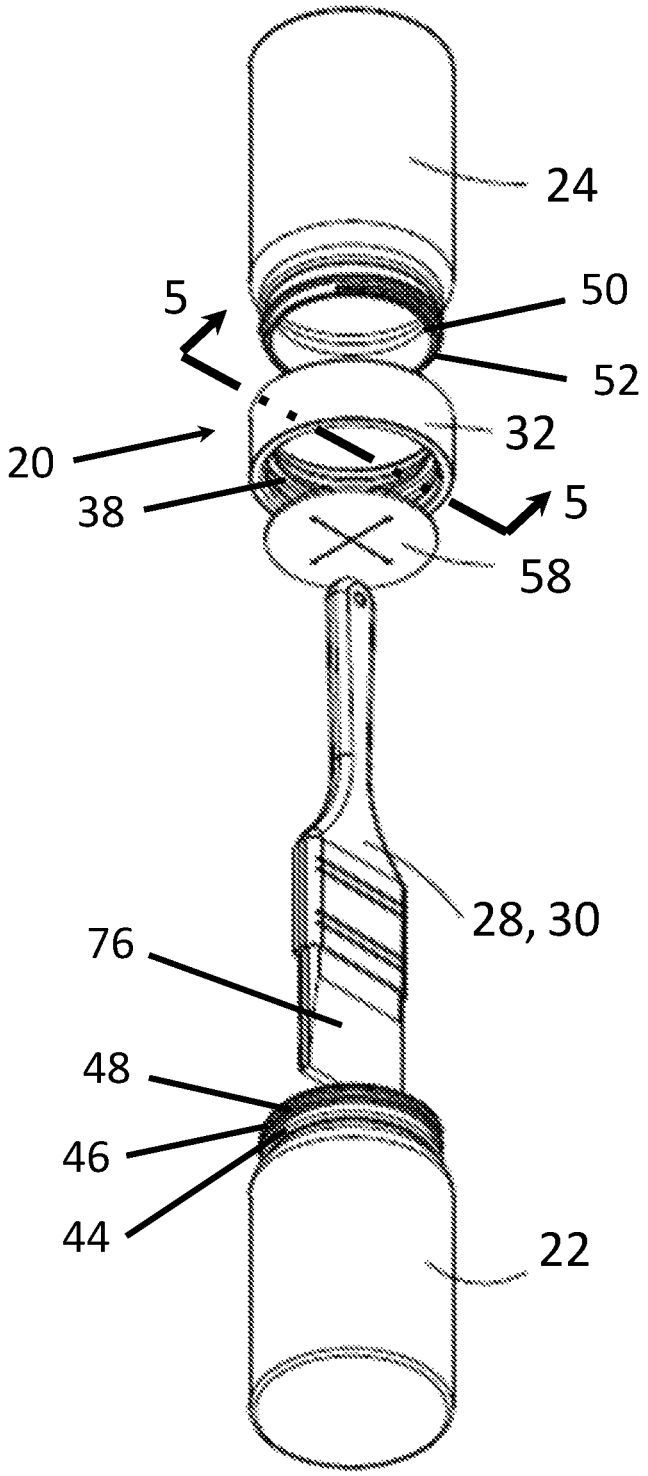
FIG. 2 is an exploded view of a vessel connector assembly, having a vessel connector including a support membrane for supporting an object, said vessel connector is shown attached to two vessels.

For purposes of the following description, the terms "upper," "lower," "left," "rear," "front," "vertical," "horizontal" and derivatives of such terms shall relate to the invention as oriented in FIG. 2. However, it is to be understood that the invention may assume various alternative orientations and configuration, except where expressly specified to the contrary. It is also to be understood that the devices illustrated in the attached drawings, and described in the following specification are simply exemplary embodiments of the inventive concepts described herein. Specific dimensions and other physical characteristics relating to the embodiments disclosed herein are not to be considered as limiting unless expressly stated otherwise.

Figure 3:
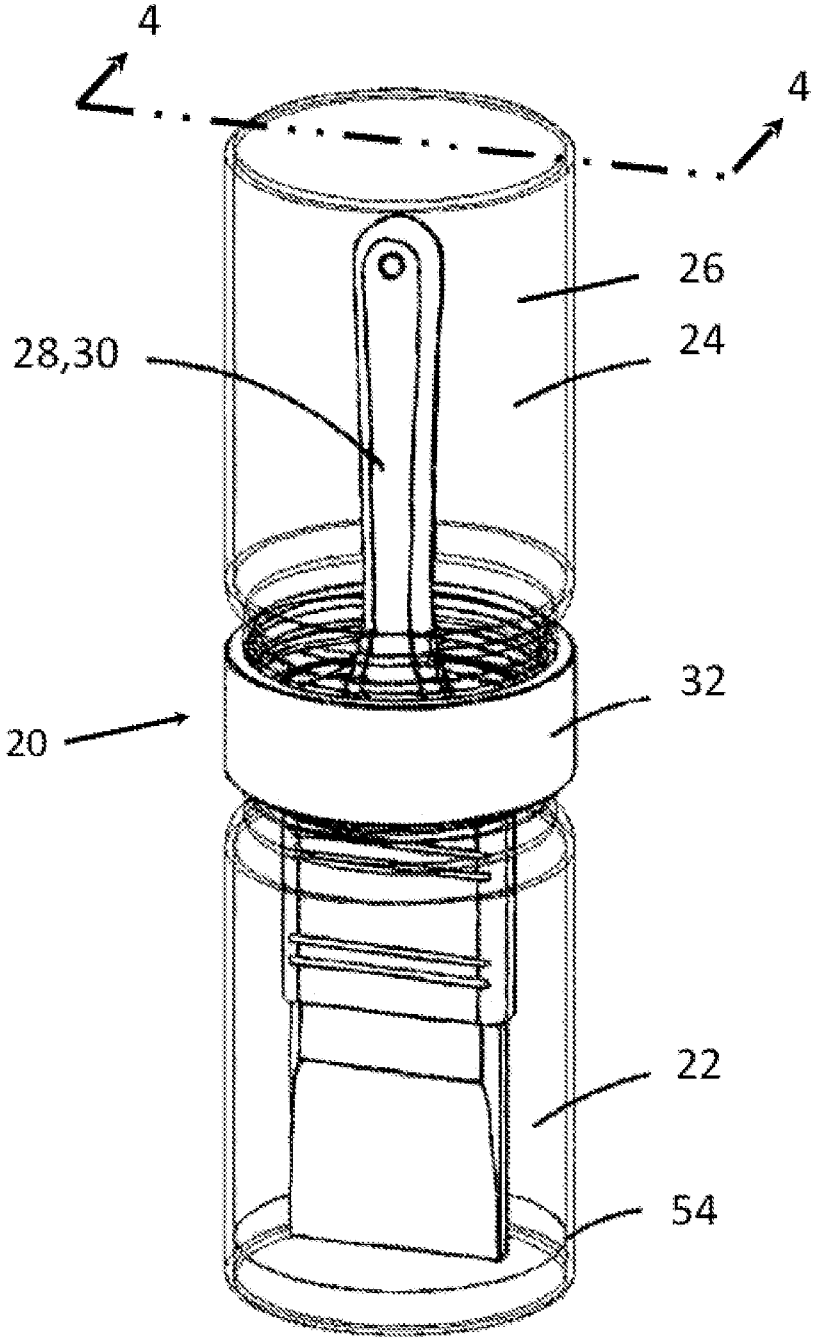
FIG. 3 is a perspective view of a vessel connector assembly shown supporting a supported object within the vessel.
Figure 4:
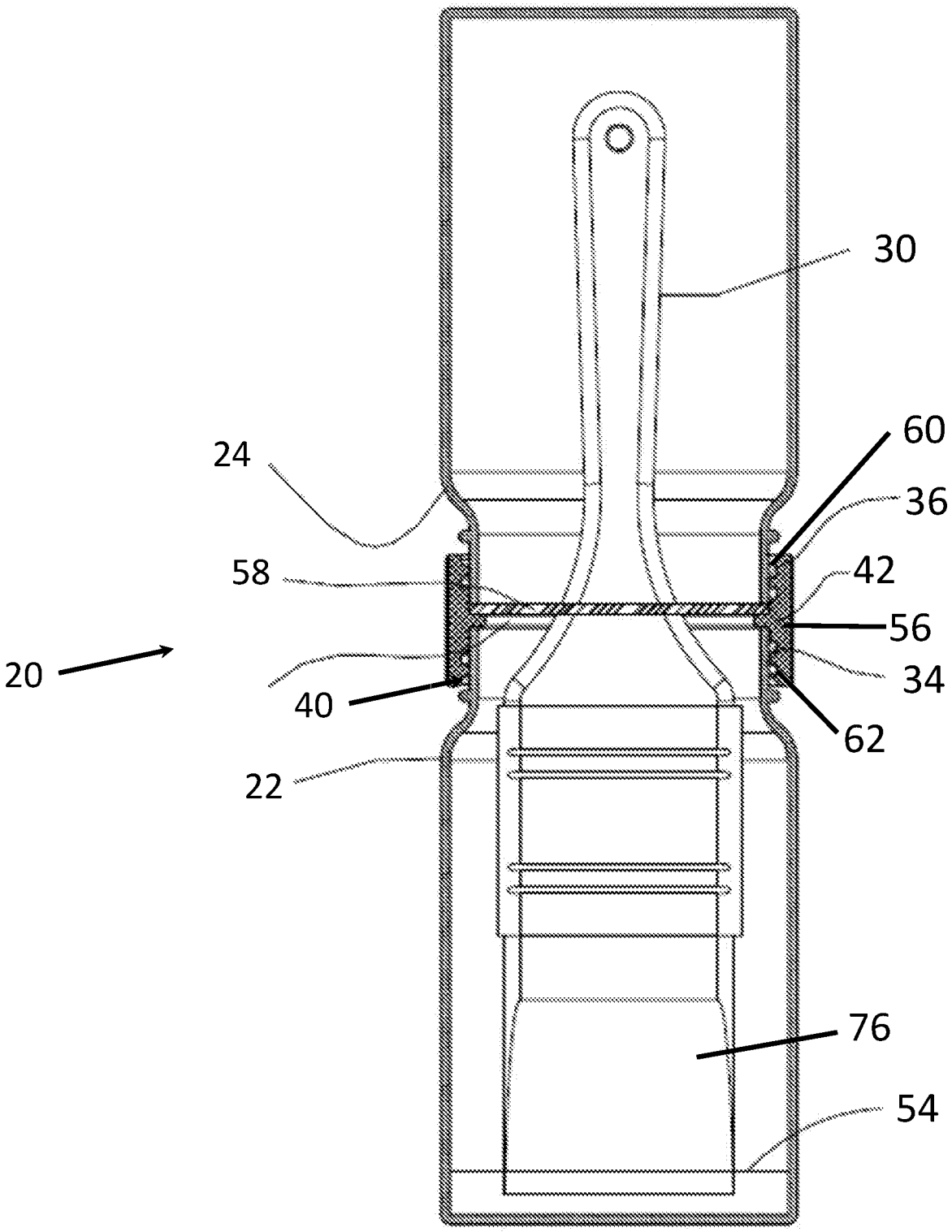
FIG. 4 is a cross sectional view of the vessel connector assembly taken at section 4-4 in FIG. 3.

In one form of the invention as shown in FIG. 2 (exploded assembly view) and FIG. 3 (assembled) the vessel connector 20 is assembled to two separate vessels 22, 24 forming an enclosed environment 26 which provides for the support of an object 28, such as a paintbrush 30, inside this environment. As best visualized in FIG. 4, this is accomplished by providing an annular ring 32 having: a first thread 34 sized to mate with a first threaded vessel 22; a second thread 36 sized to mate with a second threaded vessel 24; a flange 38 located on an inside surface 40 of the annular ring 32 and centered 42 between the first thread 34 and the second thread 36; and wherein the first thread 34 and said second 36 thread are co-axial with each other. The first vessel 22 has a threaded opening 44 on a top portion 46 which terminates in a lip 48 and the second vessel 24 has a threaded opening 50 on its bottom portion 52.

Figure 5:
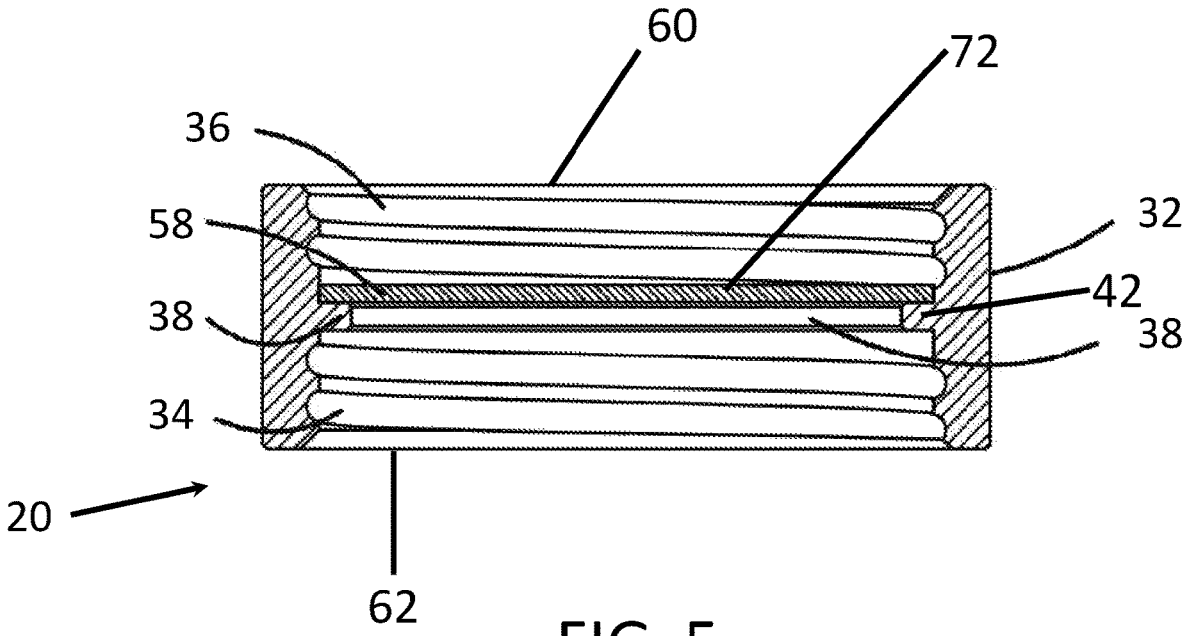
FIG. 5 is a cross sectional view of the vessel connector itself, taken at section 5-5 in FIG. 2.

Concerning the annular ring 32, which is best seen in FIG. 5, the material selected for the ring should be resistant to the solvents 54 placed into the vessel, preferably being a Polypropylene (PP) or Chlorinated Polyvinylchloride (CPVC). The wall thickness 56 should be sufficient to support loads placed upon it when the vessels are affixed the ring. In its ideal form, the annular ring 32 should be impermeable to the solvents 54, and is preferably capable of hermetically sealing 26 the vessels 22, 24 when assembled.

The flange 38 within the annular ring 32 is located on its inside surface 40 and the should be thick enough and extended away from the inner surface 40 of the annular ring 32 a sufficient distance to allow the flange 38 to seal against the vessel's lip 48 or against a support membrane 58 (discussed below). The flange 38 is not limited in size or location, except where explicitly claimed to be centrally located 42. However, it is preferably located between the threads 34, 36, if threads are present in the particular embodiment. The flange 38 may be located at a top portion 60 or a bottom portion 62 of the annular ring 32, especially if only one surface is threaded 34. Further the flange may extend the majority of the way to the center of the annular ring 32. In this instance the support membrane 58 may be reduced in size.

Figure 6:
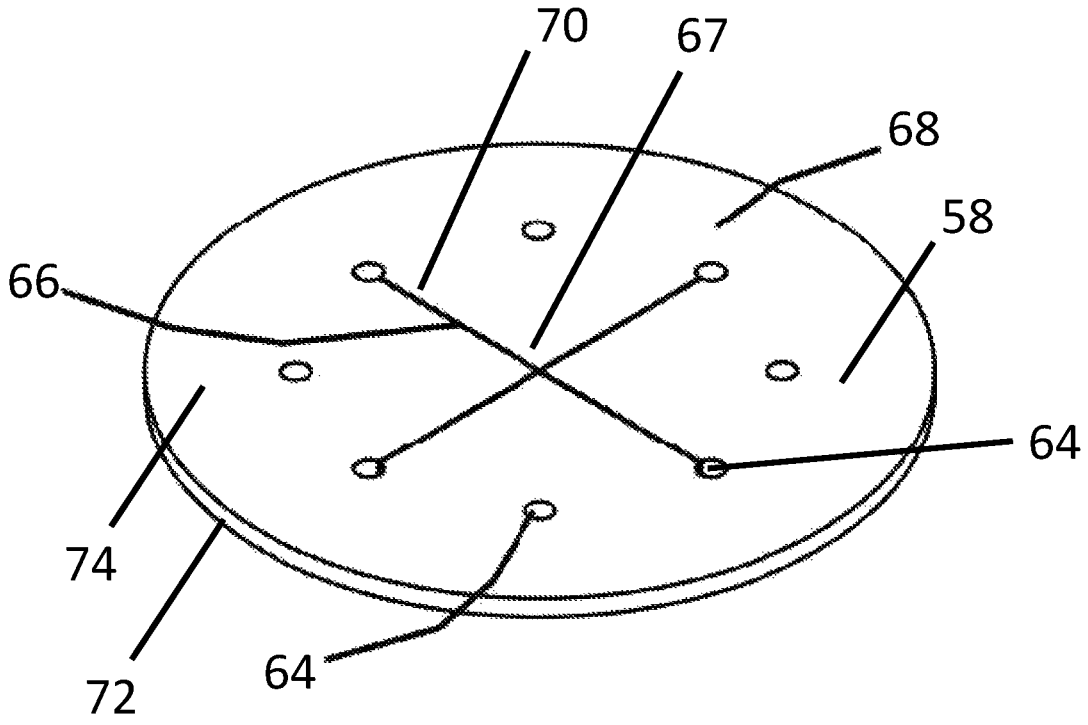
FIG. 6 is perspective view of the support membrane.

A preferred form of the support membrane 58 is shown in FIG. 6 and has at least one drain hole 64 and at least one perforation 66. The preferred purpose of the support membrane 58 is to support and locate an object 28, such as paintbrush 30 passed through a perforation 66 while limiting vapors and fluids from passing through its material, excepting locations where drain holes 64 are located. The support membrane 58 is preferably circular in shape 68 and is sized to fit snugly into the annular ring 32, therefore it is preferably smaller in diameter then the threads 34, 36 and larger in diameter than the flange 38. In one embodiment the support membrane 58 is a sheet of material which is capable of being deflected (pliable), but which provides a restorative force (resilience) biasing the perforation 66 toward a planar (closed) position 70. The thickness 72 and material of the support membrane 58 should be chosen to provide sufficient lateral and vertical support to an object placed through a perforation therein 66, such that the object 28 is held in place inside of a vessel 22, 24 when the annular ring 32 is assembled to it. The perforations may be multiple in number and location, though in the preferred embodiment shown in the figure, there are two perforations 66 which are slit like and form an 'X' shape. This provides four finger like protrusions 67 which support the object 28. The inventions, however, is not limited to this shape, and may include additional perforations 66, creating addition finger like protrusions 67, such as a (star) shape. Alternate forms of the perforation 66 include perforations which contain alternate shapes which do not fully close when in a closed position 70, such as oval, rectangular, or round shapes. Further, several perforations 66 may be included to support multiple objects 28. Similarly, drain holes 64, used for passing fluids such as solvent 54 from one side of the support, membrane 58 to the other may include any shaped opening that allows fluid to pass through the membrane, including non-circular shapes, though circular shapes are preferred. The preferred materials for the support membrane include Silicone, Viton®, and Buna-n (nitrile) rubbers, which are selected for their ability to resist solvents.

The support membrane in one preferred form (See FIG. 6) contains at least one, and preferably two perforations 66 through its body 74. Additional drain holes 64 may be placed through the membrane and act to relive stress at the ends of the perforation 66 and allow fluids to pass from one vessel to the other. In instances where only one vessel 22 is utilized, such as when a paint brush handle is allowed to be exposed to open air, the through holes 64 should be omitted and left out of the design. This omission of the drain holes is done in order to minimize the solvent's 54 evaporation to the open air when a second vessel 24 is not present to capture the vapors.

Vessels 22, 24 represent any container capable of being closed by the vessel connector 20, large enough to insert an object 28 to be held, and capable of holding a solvent 54. A preferred vessel is a wide mouthed jar, such as a Ball Mason® jar. These jars are preferred because: they present an opening large enough to insert objects 28, such as paint brushes 30 through their mouth; are made of glass which is resistant to most solvents 54; they are inexpensive; readily available; deep enough to encompass the entirety of a paint brushes, including their bristles 76; and contain threaded orifices 44, 50 terminating at an upper lip 48 (the edge located at the top of the vessel). Further, these jars provide a convenient thread to assemble the annular ring 32 to. If used with such ajar, the first thread 34 and second thread 36 of the annular ring 32 will be sized to mate with the jar's threaded opening 44, 50.

Alternate methods of attaching the vessel connector 20 to a vessel 22, 24 include the compression of a seal onto an inside surface portion 40 of the vessel 22, 24, similar to a cork into a bottle. Another alternate manner of attaching the vessel connector 20 to a vessel includes compressing the vessel connector over an external portion of a vessel 22, 24. One embodiment of an external compression attachment includes a locking lip such as that used with a Tupperware® container, or a snap on feature like those used with cola bottles.

Assembly of the components in a preferred form of the invention—The first (lower) vessel 22 is threaded onto the annular ring 32 causing its flange 38 to compress the support membrane 58 against the first vessel's lip 48 creating a seal between the annular ring's flange 38 and the first vessel 22. The second vessel 24 is then screwed onto the top side 60 of the annular ring 32 forming an enclosed environment.

Minimal Form—Since the vessel connector 20 described herein is an apparatus capable of sealing a vessel 22, it may comprise just the vessel connector itself. The connector is comprised of an annular ring 32 having a flange 38 located on its inside surface 40. This flange 38 supports a support membrane 58 having at least one perforation 66 which is sized to support and locate an object 28 passed through the perforation. It is suitable for mounting to a vessel 20, and is capable of locating and supporting the object 28 inside the vessel and while allowing a portion of the object 28 to pass through the perforation in the support membrane 58. In its simplest form, the inventive device is that which is shown in FIG. 5, and is comprised of the annular ring 32, flange 38 and support membrane 58 having a perforation 66. The vessels 22, 24, and supported object 28 may be provided by the consumer, but are optional elements to the apparatus as claimed in its minimal form.

Figure 7:
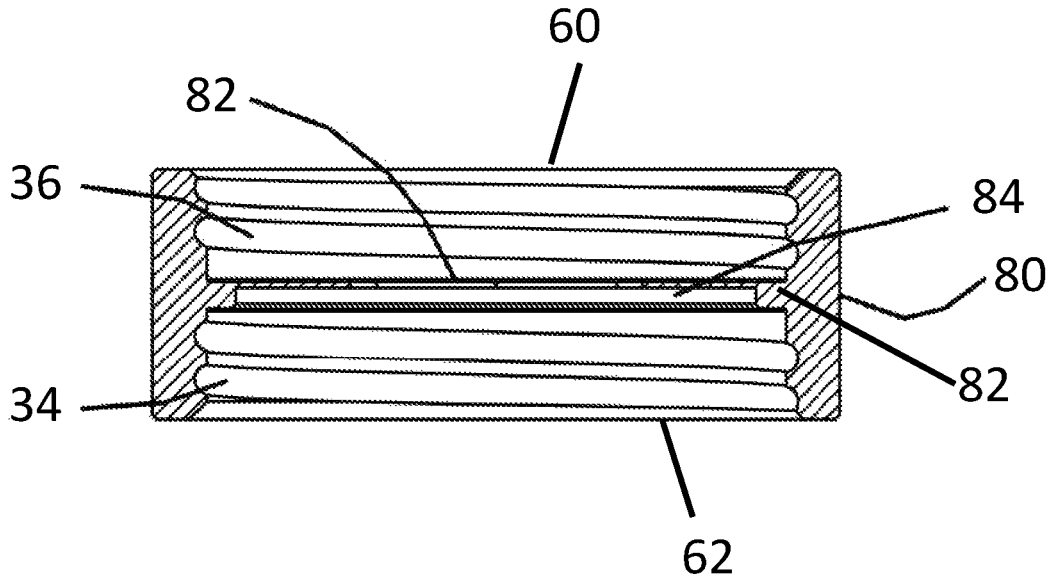
FIG. 7 is a cross sectional view of an alternative embodiment of the invention, taken at line 5-5 in FIG. 2, wherein the alternate embodiment is shown with the support membrane integral to the vessel connector.

An alternate embodiment of the minimal form of the invention is shown in FIG. 7, and comprises an overmolded annular ring 80 having a flange 82 with an integral support membrane 84 which is over molded 86 onto the flange 82 thereby providing a unified vessel connector. Preferably, the over molding 86 assists with sealing to the vessels 22, 24 when included, as the over molded material is preferably is a compressible medium that will provide a seal between the flange 82 and the vessel lip's 48 when assembled together.

Method of Use—When a paint brush 30 is used for a project such as with a paint or stain, the paint or stain will contaminate the brush. In order to clean the brush, we will fill a portion of the lower vessel 22 with a compatible solvent 54 that will dissolve the contamination contained on the paintbrush 30. In order to remove the contamination, one must work the brush's bristles 76, first into the solvent 54, and then against the wall of the lower vessel 22, ensuring to work the solvent through the entirety of the brush. Once the brush has been cleaned, we will take the vessel connector's annular ring 32 and support membrane 58 and place the paintbrush 30 handle through the perforation 66 in the support membrane 58 far enough that the paint brush will not contact the inside of the lower vessel 22 when inserted into the lower vessel 22. Now, we will attach the vessel connector onto the lower vessel 22 enclosing the bristles 76 inside the vessel with the solvent 54. Then, if one chooses to use an upper vessel 24, we then affix the upper vessel 24 to the annular ring 32. Use of the upper vessel 24 is suggested as it creates a sealed container with a brush stored within (See FIG. 2 and FIG. 4). This slows or prevents evaporation of the solvent 54 inside the container and allows the paintbrush's bristles 76 to remain wetted until needed again.

At a later time, the container may be opened by removing the vessel connector 20 from the lower vessel 22 and removing the paintbrush 30 from the support membrane 58. The still wet brush should then be worked into the solvent 54 a second time and against the wall of the lower vessel 22 flushing any remaining particulates from the bristles 76. The brush may then be wiped on a cloth (not shown) to dry the brush reading it for use.

Preparing new brushes for use—Similar to the steps to cleaning set forth above, a new brush 30 may be prepared for use by wetting the brush in a compatible solvent 54 by adding a solvent 54 to the lower vessel 22, wetting the bristles 76, and then taking the vessel connector's annular ring 32 and placing the paintbrush 30 through the perforation 66 in the support membrane 58. As before, we will insert the brush into the assembly far enough that the paint brush will not contact the inside of the lower vessel 22 when inserted into the lower vessel 22. Then we affix the vessel connector 20 onto the lower vessel 22 enclosing the wetted bristles 76 in the vessel with the solvent 54 for a period of time until the brush is needed.

Reclamation and recycling of used solvent—If a vessel 22 filled with solvent 54 is left for a period of time with particulate matter in the solvent 54, the particulates will typically begin to settle to the bottom of the vessel 22. If an upper vessel 24 is then added to the annular ring 32 and the container is then slowly tipped, clean solvent may be passed from one vessel to the other without spilling. If done slowly, the heavier particulate matter will remain in the original vessel. In embodiments where the support membrane 58 has drain holes 64, these drain holes will allow solvent to pass from one vessel to the other. The particulate matter remaining in the lower vessel may then be discarded, and the solvent 54 remaining in the other vessel may be reused.

The above description is considered that of the preferred embodiments only. Modifications to the invention will occur to those skilled in the art and those who make use of the invention. Therefore, it is understood that the embodiments shown in the drawings and the examples set forth herein are described merely for illustrative purposes, and are not intended to limit the scope of the invention as interpreted according to the principles of patent law, including the doctrine of equivalents.

The invention claimed is:

1. An apparatus for supporting a paintbrush and sealing a vessel comprising:

a first vessel having an opening on a top portion, said opening forming a lip;

a second vessel having an opening on a bottom portion;

an annular ring having a flange on an inside surface;

a support membrane having at least one perforation supporting and locating a paintbrush passed through the perforation;

wherein said support membrane is pliable and provides a restorative force biasing the perforation toward a planar position around said paintbrush;

wherein said annular ring is mated with said first vessel;

wherein said flange contacts and supports said support membrane;

wherein said annular ring is sized to mate with said second vessel; and wherein said second vessel is mated with said annular ring forming an enclosed environment.

2. The apparatus as defined in claim 1, wherein:

said first vessel is threaded;

said annular ring contains a first thread sized to mate with said threaded first vessel; and wherein said annular ring is screwed onto said first vessel.

3. The apparatus as defined in claim 1, wherein:

said first vessel is threaded;

said annular ring contains a first thread sized to mate with said first vessel;

said second vessel is threaded;

said annular ring contains a second thread sized to mate with said second vessel; and wherein said annular ring is screwed onto said first vessel and onto said second vessel.

4. The apparatus as defined in claim 3, wherein said first thread sized to mate with said first vessel and said second thread sized to mate with said second vessel on said annular ring are co-axial and wherein said flange separates said first thread sized to mate with first vessel and said second thread sized to mate with second vessel.

5. The apparatus as defined in claim 4, wherein said flange is centered inside said annular ring.

6. The apparatus as defined in claim 1, wherein said support membrane further comprises at least one drain aperture placed through said support membrane.

7. The apparatus as defined in claim 1, wherein said support membrane is over molded to said flange.

8. The apparatus as defined in claim 1, wherein said annular ring further comprises an outer diameter and a height; and wherein said outer diameter exceeds said height.

9. The apparatus as defined in claim 1, wherein a solvent is placed into said first vessel and lies in contact with said paintbrush.

10. An apparatus for supporting a paintbrush and sealing a vessel comprising:

a first threaded vessel having a threaded opening on a top portion terminating in a lip;

a second threaded vessel having a threaded opening on a bottom portion;

an annular ring having:

a first thread sized to mate with said first threaded vessel;

a second thread sized to mate with said second threaded vessel;

a flange located on an inside surface of said annular ring and centered between said first thread and said second thread; and wherein said first thread and said second thread are co-axial;

a support membrane having:

at least one perforation supporting and locating a paintbrush passed through said perforation;

wherein said support membrane is pliable and provides a restorative force biasing the perforation toward a planar position around said paintbrush;

wherein said threaded first vessel is threaded onto said annular ring causing said flange to compress said support membrane against said lip thereby fixing a peripheral edge of said support membrane and creating a seal between said flange and said lip;

wherein said flange contacts and supports said support membrane beyond said peripheral edge; and wherein said threaded second vessel is threaded onto said annular ring forming a hermetically sealed environment.

11. An apparatus for supporting an object and sealing a vessel comprising:

a first vessel having an opening on a top portion, said opening forming a lip;

a second vessel having an opening on a bottom portion;

an annular ring having a flange on an inside surface;

a support membrane having at least one perforation supporting and locating an object passed through the perforation;

wherein said support membrane is pliable and provides a restorative force biasing the perforation toward a planar position around said object;

wherein said annular ring is mated with said first vessel;

wherein said flange contacts and supports said support membrane;

wherein said annular ring is sized to mate with said second vessel;

wherein said second vessel is mated with said annular ring forming an enclosed environment;

said annular ring is mated with said first vessel causing said flange to compress said support membrane against said lip, thereby fixing a peripheral edge of said support membrane and creating a seal between said flange and said lip; and wherein said flange contacts and supports said support membrane beyond said peripheral edge.

12. A method for supporting a paintbrush, comprising the steps of:

providing a first vessel having an opening on a top portion, said opening forming a lip;

providing a second vessel having an opening on a bottom portion;

providing an annular ring having a flange on an inside surface; wherein said flange supports a support membrane having at least one perforation, and wherein said annular ring is sized to mate with said first vessel;

passing said paintbrush through said perforation supporting and locating said paintbrush passed through said perforation, and wherein said support membrane is pliable and provides a restorative force biasing said perforation toward a planar position around said paintbrush;

assembling said first vessel to said annular ring; and assembling said second vessel to said annular ring thereby creating an enclosed environment enclosing said paintbrush.

13. The method as defined in claim 12, further comprising the step of:

assembling said first vessel to said annular ring causing said flange to compress said support membrane against said lip thereby fixing a peripheral edge of said support membrane and creating a seal between said flange and said lip.

14. The method as defined in claim 12, further comprising the step of:

creating a hermetic seal for said enclosed environment.

15. The method as defined in claim 12, further comprising the steps of:

providing a first vessel which is threaded;

providing a second vessel which is threaded;

providing a first thread on said annular ring sized to mate with said threaded first vessel;

providing a second thread on said annular ring sized to mate with said threaded second vessel; and threading said annular ring onto said threaded first vessel and said threaded second vessel.

16. The method as defined in claim 12, further comprising the step of:

adding a solvent to said first vessel.

17. The method as defined in claim 16, wherein the step of passing said paintbrush through said perforation, further comprises the steps of: providing said paintbrush having a set of bristles; and placing said paintbrush into said perforation causing said paintbrush to be supported by said perforation and oriented such that said set of bristles are located within said first vessel when said annular ring is attached onto said first vessel.

18. The method as defined in claim 17, further comprising the step of:

cleaning said set of bristles in said solvent.

19. The method as defined in claim 18, further comprising the steps of:

providing at least one drain aperture placed through said support membrane;

providing a first vessel which is threaded;

providing a second vessel which is threaded;

providing a first thread on said annular ring sized to mate with said threaded first vessel;

providing a second thread on said annular ring sized to mate with said threaded second vessel; and threading said annular ring onto said threaded first vessel and said threaded second vessel thereby creating an enclosed environment enclosing said paintbrush.

20. The method as defined in claim 19, further comprising the steps of:

allowing a particulate to settle out of said solvent and into said first vessel following the step of cleaning said set of bristles in said solvent;

reclaiming a portion of said solvent by pouring said solvent from said first vessel into said second vessel via said drain aperture in said support membrane; and discarding said particulate remaining in said first vessel.

* * * * *